US005915878A

United States Patent [19]

Carpenter

[11] Patent Number: 5,915,878

[45] Date of Patent: Jun. 29, 1999

[54] SILT FENCE MACHINE

[76] Inventor: Thomas Joseph Carpenter, 1301 SE. Trilein Dr., Ankeny, Iowa 50021

[21] Appl. No.: 08/779,479

[22] Filed: Jan. 7, 1997

[51] Int. Cl.[6] ..... E02F 5/10

[52] U.S. Cl. ..... 405/38; 405/270

[58] Field of Search ..... 405/38, 270, 50, 405/36, 176, 179, 180, 267

[56] References Cited

U.S. PATENT DOCUMENTS

| | | | |
|---|---|---|---|
| 2,314,045 | 3/1943 | Johnson . | |
| 2,393,395 | 1/1946 | Millard . | |
| 3,182,459 | 5/1965 | Grether et al. | 405/270 X |
| 3,405,528 | 10/1968 | Hansen et al. | 405/38 |
| 4,200,410 | 4/1980 | Baker | 405/182 |
| 4,720,212 | 1/1988 | Steenbergen et al. | 405/38 X |
| 4,927,297 | 5/1990 | Simpson | 405/270 |
| 4,929,126 | 5/1990 | Steenbergen | 405/267 |
| 5,320,454 | 6/1994 | Walling | 405/267 |

OTHER PUBLICATIONS

ERO–CON Information sheet for Silt Fence Machine.

*Primary Examiner*—Tamara L. Graysay
*Assistant Examiner*—Frederick Lagman

[57] ABSTRACT

A device for slicing through soil and simultaneously inserting silt fence into the soil. Silt fence is a synthetic material installed in and above the ground to impede silt erosion from areas disturbed by construction. The device comprises a soil disrupter for slicing thinly through the soil 8 inches to 12 inches deep, and an apparatus, operating at the same depth, for converting silt fence, manufactured on a roll, into a vertical position in and above the ground. The apparatus includes a vertical wheel operating between two parallel panels, acting as a moving pivot point where the horizontal silt fence is converted to a vertical position between the panels. The panels hold the soil open while the vertical wheel simultaneously inserts silt fence into the opening. As the machine progresses, soil collapses against the silt fence, thus securing the silt fence in the desired position.

15 Claims, 4 Drawing Sheets

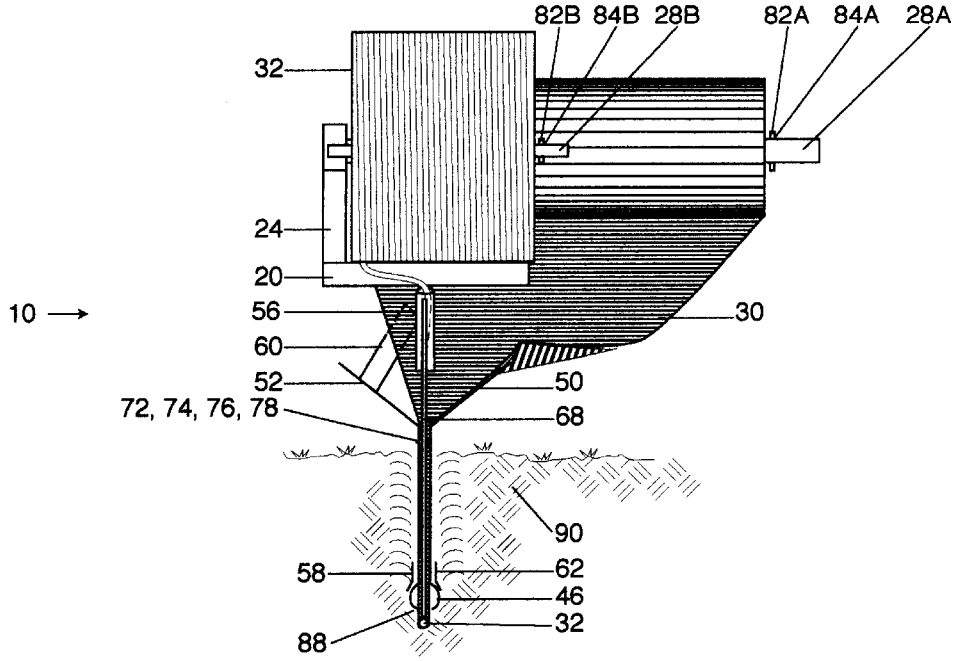
Fig. 5
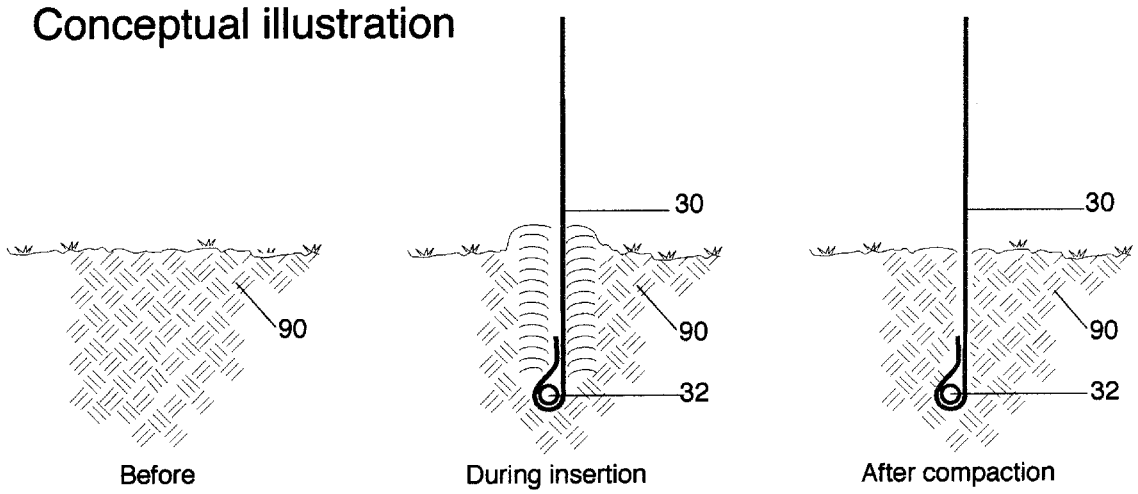
Fig. 6a Fig. 6b Fig. 6c
Fig. 6

SILT FENCE MACHINE

BACKGROUND OF THE INVENTION

1. Field of the Invention

The invention pertains to earth working equipment, more particularly to a machine comprising a soil disrupter for slicing through the soil and an apparatus for inserting silt fence into the soil in a secure and proper position.

2. Description of Prior Act

In the construction field, silt fence is a synthetic material, about the weight of canvas and 91 cm to 107 cm wide, installed around construction sites, disturbed areas, and in ditches to retain silt while allowing water to slowly pass through. Approximately, 46 cm to 56 cm remains above the ground supported by posts, and the balance is buried in the ground as an anchor. Most installation procedures follow engineering specifications calling for a trench 300 mm deep and 150 mm wide with a lap of silt fence covering the bottom of the trench to be covered and compacted with soil.

Erosion control, including silt fence, is mandated on all federal projects and on many urban projects, both public and private. Millions of feet are installed each year. An improvement in the speed of installation would reduce costs to the public that are both taxpayers and consumers. An improvement in the speed of installation would reduce costs to the public who are both taxpayers and consumers. An improvement in quality would reduce erosion into our environment.

There are a few mowboard plow type machines within the industry, which have been adapted to open up a trench, lay fabric down, and pull soil back over the fabric to hold it in place. These machines are large, bulky, and move a lot of soil, which is difficult to backfill in most situations. They do not conform to engineering specifications because of the large trench they form and poor compaction capabilities. Also, the large machines are difficult to maneuver in many areas required for silt fence.

Contractors from all over the country, hands-on people and large companies knowledgeable in the art and part of the industry, have attempted to build a machine that installs silt fence efficiently and effectively. None have designed a means to do so, and no one utilizes any of the existing patents or any part thereof, to any commercial, or private success.

Currently, most contractors use a trenching machine to dig and excavate a 150 mm deep trench, after which they pound in steel posts, manually hang silt fence on the posts with a short lip of fabric on the bottom of the trench for soil to rest on, and then manually backfill by pushing the excavated soil into the open trench with a blade on their machine.

1. U.S. Pat. No. 5,320,454 to Walling, which illustrates a roller machine for installing a flexible panel. This machine bends a semi-rigid panel, via a system of rollers, 180 and directs it vertically into a previously dug trench.

2. U.S. Pat. No. 4,929,126 to Steenbergen et al., which illustrates a method for installing a screen in the soil. This system defines a screen, which is modified at the manufacturing point so that it does not drop or sag in the still open, previously dug trench, before it is backfilled, or the screen is actually filled to take up the void of the trench.

3. U.S. Pat. No. 4,927,297 to Simpson, which illustrates a leak prevention structure, method apparatus. This system builds a wall under ground level by driving a beam into the ground in a sequence of successive insertions, and then drops a curtain wall into the compacted trench.

4) U.S. Pat. No. 4,720,212 to Steenbergen, et al, which illustrates excavating a trench and inserting a fabric material with a series of rods, rollers, and plates which attempt to unfold or unravel fabric which has been folded and placed on a roll. This system is very cumbersome and is unlikely that the fabric unfolds in a reasonable manner because there is no way to maintain even tension on the fabric while it is pulling off of the roll. Any uneven tension would cause bunching and failure to operate.

5) U.S. Pat. No. 4,705,427 to Atkins illustrates installing fabric into the soil in an elongated furrow path. While different from the current proposal, it was identified by U.S. Pat. No. 2,393,395 to Millard.

6) U.S. Pat. No. 4,200,410 to Baker et al., which illustrates a cable laying device. This machine excavates a trench in frozen or unfrozen soil and introduces a cable within said trench, a vibrating or reciprocating moving blade breaks frozen soil and sod and angulated projections lift soil from the trench. The description for Baker patent details lifting soil from the trench, soil lifting to excavate a trench, maximum upward elevation of trench, and excavation from a trench. Its object as stated is to provide an efficient soil raising device for cutting a forming a trench and to provide vibratory blade cutting means. The vibrating plow is very complex, has many moving parts, and is costly to purchase and maintain.

7) U.S. Pat. No. 3,405,528 to Hansen and Speer, which illustrates method to create an artificial water table. Hansen describes a wedge-shaped subterranean plow attached to a shank which is pulled through the soil at a pre-selected depth. Hansen does not describe the use to help pull his machine into the soil, does not describe using the plow to minimally disrupt soil, does not describe its use as a point, in conjunction with slicing or trenching, nor to be used to minimize horizontal soil compaction. He is using it to lift a large area of soil for the purpose of a creating a temporary cavity.

8) U.S. Pat. No. 3,182,459 to T. H. Grether, et al, to illustrate an apparatus for positioning fluid barriers in soil. The concept is similar to my proposal, but fails to anticipate or identify the problems of getting the machine into the soil, fails to identify the horizontal compaction caused by the device as it would travel through most soils, and fails to solve many problems associated with moving fabric through a series of rods and severe turns.

Important problems with Grether

As designed, penetrating most soils would be difficult, and displacing 50 mm of most types of soils (except sand) would create horizontal compaction and a substantial trench that would require back-filling and compaction, leaving little soil for friction to pull the fabric from the machine, and little soil to hold the base of the fabric in the trench before back-filling, as stated.

The horizontal compaction would create very stable side walls of the trench 50 to 75 mm apart, eliminating most chances of the soil sealing against the fabric.

The defined fabric handling mechanisms would be very sensitive to variations in the tension created by the soil pulling the fabric through the machine. It is well-documented that fabric flowing over a pivot mechanism must have even tension across the breadth of fabric—the slightest pressure off-center would pull the fabric into a bunch and clog the machine. The same concept applies to the right angle conversion mechanism, fabric would tend to bunch and clog instead of flowing through as planned. In construction areas, where terrain is always variable, and therefore tension on the fabric is also variable, it is doubtful whether fabric would ever flow through this mechanism.

Heavy, stiff, and/or doubled over fabrics would also add significantly to these fabric flowing concerns.

As designed, a significant amount of time would be required to thread fabric, folded or not, through and around the rollers and rods, in-between 2 narrow plates, with no external access.

9) U.S. Pat. No. 2,393,395 to Millard illustrates a plow share opening up a furrow, vertical fabric unrolling in the furrow, and disc blades pushing soil back onto the fabric. This would only work in friable soils and is quite different from the current discussion.

10) U.S. Pat. No. 2,314,045 to Johnson illustrates installing fabric with a ground slitting disc, but does not address the current proposal. There are many functional problems associated with the prior art. But primarily, the prior art does not suggest the combination of a horizontal chisel point and the slicing blade, whose combination minimizes horizontal compaction and pulls the device into the soil. Nor does the prior art address the fundamental problems of variable fabric tensions and dimensions at the pivot points, which is probably why none were commercial successes.

Failure of silt fence usually occurs on a slope where silt fence has been installed with no compaction or poorly compacted soil and the soil is underwashed in a heavy or fast rainfall situation. Silt fence failure is a problem for the environment and for public officials dictated by law or control erosion.

Engineering specifications call for contractors to install posts a certain depth and for the trench to be compacted. Proper compaction is usually not achieved, nor attempted.

The problems for construction companies installing silt fence are the high cost of trenching machine, the repair costs of a complex machine, and the number of labor hours, which delay productivity, such as trenching speed, man-handling an awkward 92 cm roll especially in the wind, back-filling the trench, and compacting the soil.

The silt fence machine greatly improves productivity of labor by mechanically installing hundreds of meters of silt fence per hour in a consistent, high-quality manner an in all types of soil and terrain, greatly improves maneuverability because of its compact design, greatly improves the quality of installation in the soil by creating an optimum environment for effective compaction, and the productivity ultimately reduces costs to the general public.

The silt fence machine is a combination known parts and ideas, whose operation as a unit creates a synergism which greatly increases installation production and quality of the final product over all previous common practices and all attempts at solving the problems, in a simple, yet dynamic manner.

DESCRIPTION OF THE DRAWINGS

FIG. 5 illustrates the rear view of the silt fence machine as it would operate in the ground, silt fence material funneled into the apparatus, shown as shaded, and the rope through the guide and out the back.

FIG. 6*a–c* illustrate a partial cross-section conceptual view of the soil, before operation of the silt fence machine, during operation of the silt fence machine, and after the soil has been compacted, with the silt fence material installed.

DESCRIPTION OF THE PREFERRED EMBODIMENT

Figure 1:
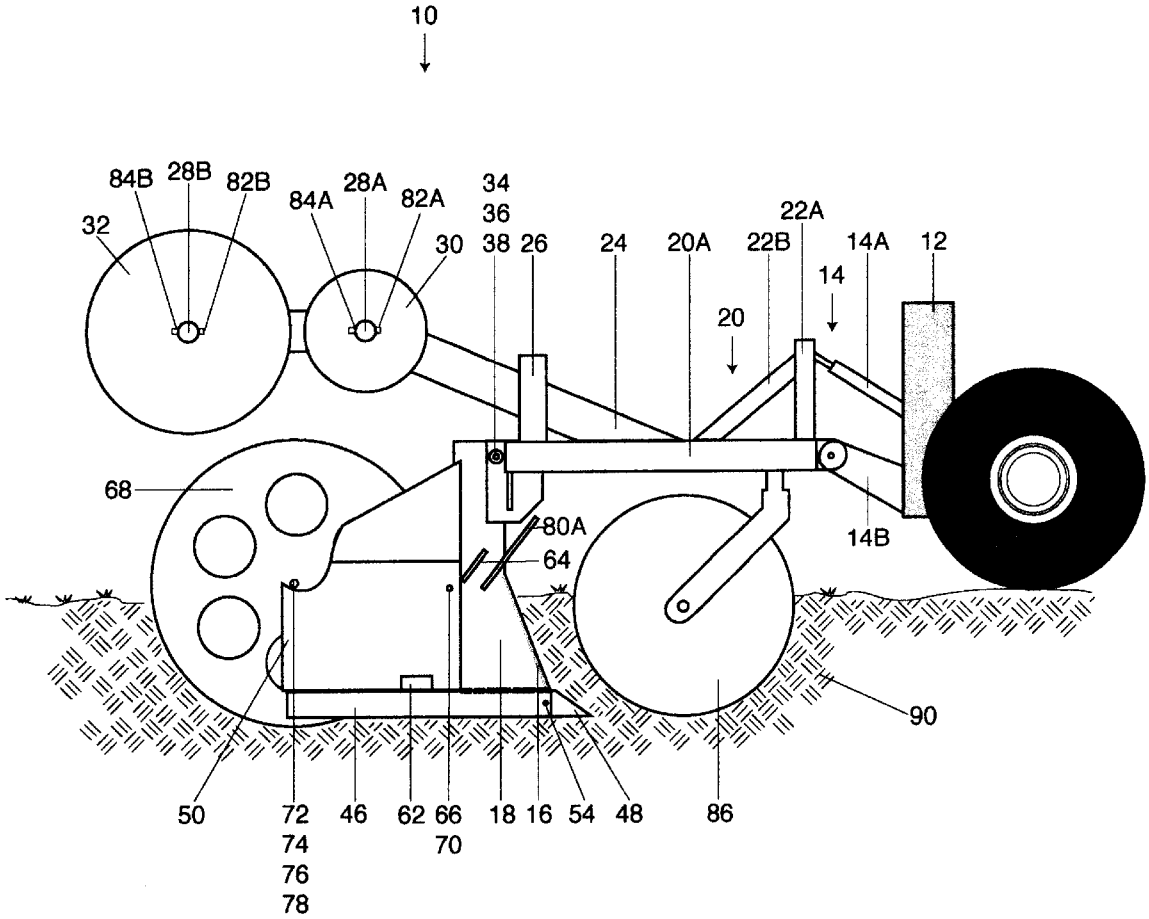
FIG. 1 illustrates the right side view of the silt fence machine attached to a towing vehicle.

Referring now more particularly to the drawings, wherein like reference numerals designate identical or corresponding parts throughout the several figures, FIG. 1 shows the silt fence machine 10 attached to a towing vehicle 12 via a conventional 3-point hitch 14, the top link being a conventional hydraulic cylinder 14A, and the lower arms 14B. The cylinder 14A directly acts to alter the angle of attack of a soil disrupter 18 for faster penetration into the soil 90, and the lower arms 14B adjust the depth of the silt fence machine 10 approximately 4 inches to 14 inches during operation. The silt fence machine 10 will operate with a standard top link, but without the speed of penetration into the soil, and can be adapted to operate with other power sources also.

Figure 2:
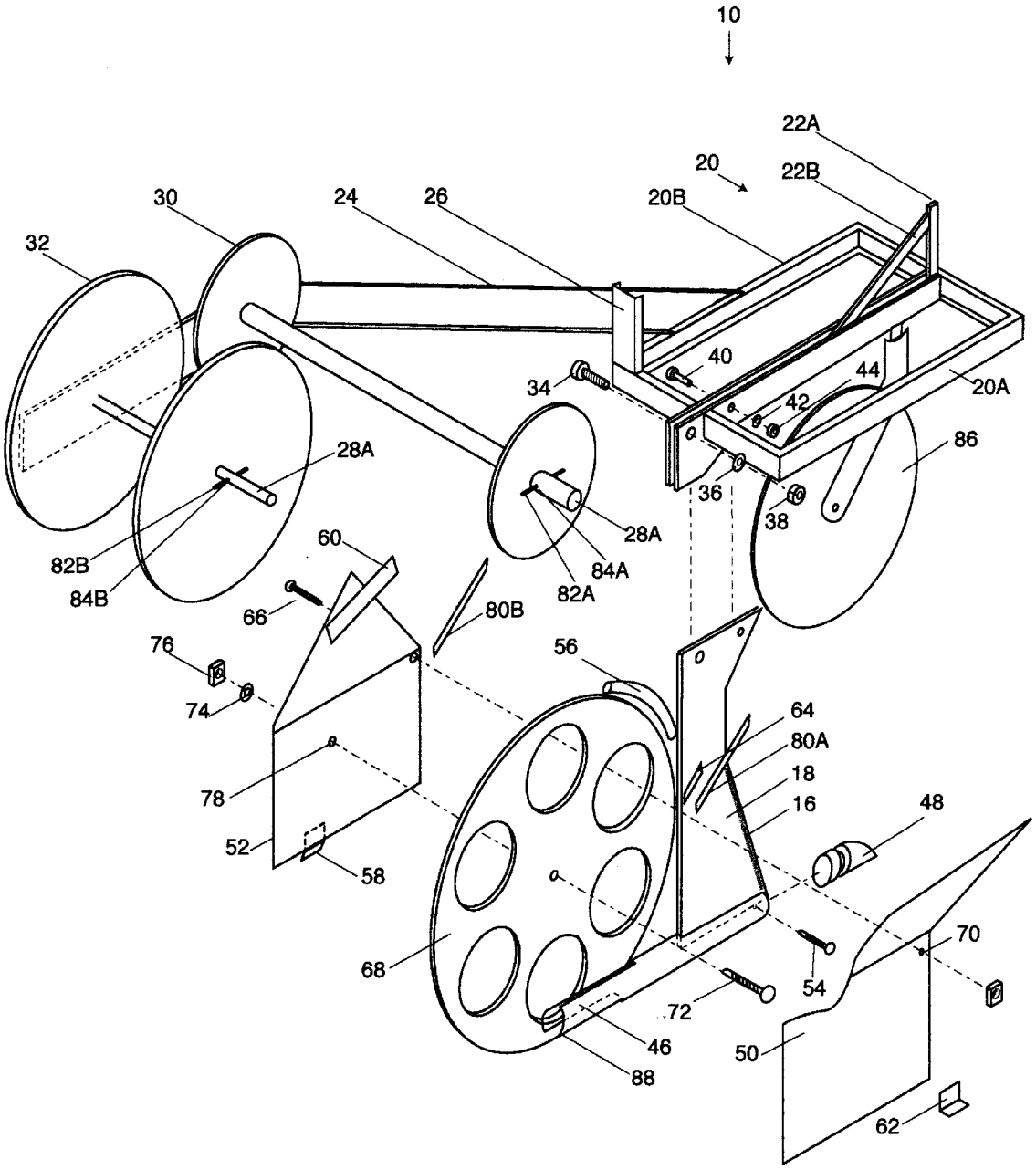
FIG. 2 illustrates the exploded right side ¾ view of the silt fence machine.
Figure 4:
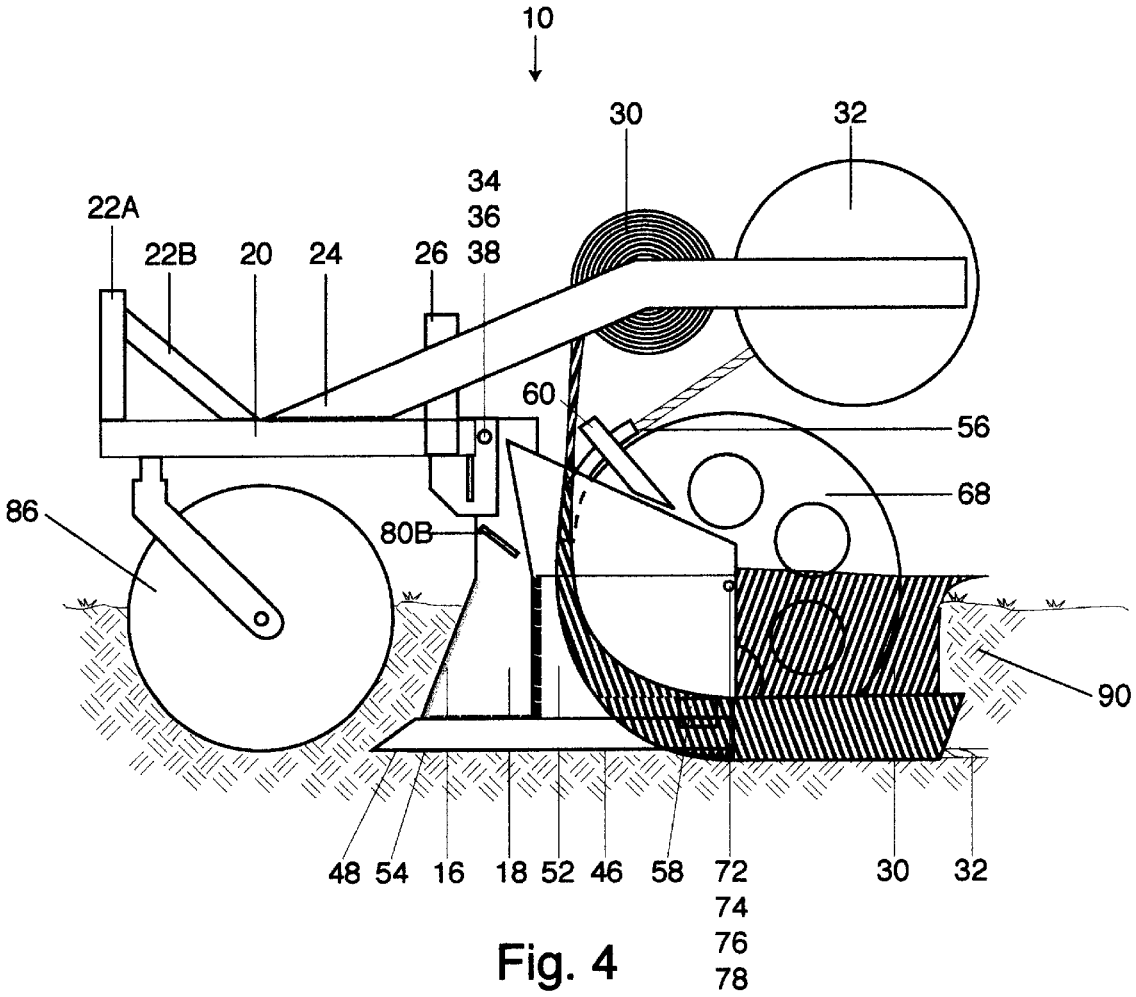
FIG. 4 illustrates the left side view of the silt fence machine with the silt fence material, as shown shaded, folded around the vertical wheel, and the rope guided into the apparatus and flowing out the rear thereof in the bottom of the fold of silt fence material.

The silt fence machine 10 includes a frame 20, FIGS. 1, 2, and 4, comprised of two c-channel frames 20A and 20B, FIG. 2, bolted together with the soil disrupter 18 sandwiched between. Top link 22A is supported with top link brace 22B. Frame 20 supports a conventional plow coulter 86 in front of the soil disrupter 18 to cut a path through trash and sod.

Rectangular tubular steel forms support structure 24, FIGS. 1, 2, 4, and 5, rigidly attached to the top left side of frame 20B in a rearwardly and upwardly position, and braced with support 26. Support structure 24 supports two lengths of standard pipe 28A and 28B welded perpendicular to said support 24 and horizontal to the ground, which hold a roll of silt fence 30 a spool of rope 32. The roll of silt fence material 30 is positioned bottom first on pipe 28A, and support structure 24 positions the bottom edge of the silt fence material 30 approximately 6 inches to 8 inches perpendicularly from the plane of wheel 68. Holes 84A and 84B are drilled at the end of each pipe 28A and 28B to accept pins 82A and 82B to hold silt fence 30 and rope 32 onto pipes 28A and 28B.

Silt fence material 30 is converted to a vertical position by wheel 68 engaging the horizontal silt fence material 30 perpendicularly, thus causing the silt fence material 30 to fold into two flaps as it flows between panels 50 and 52, and to pivot against wheel 68 (FIG. 4). The position of the silt fence material 30 on the support structure 24 determines the size of the flaps of the silt fence material 30, and thus the height of the silt fence material 30 above the fold, with the goal being one flap of the fold approximately 6 inches long, with the balance of the width of the silt fence material 30 on the other flap, partially below soil 90, and partially above soil 90, FIGS. 4, 5, and 6.

FIG. 2 details bolt 34, locking washer 36, and nut 38, securing soil disrupter 18 in frame 20, and bolt 40, locking washer 42, and nut 42, secure same and also act as a shear bolt. Soil disrupter 18 is a rigid plate of steel, approximately ¾ inch thick, presenting a forward edge 16, FIGS. 1–4, and a predetermined angle of attack, approximately 15 degrees to 40 degrees.

Physical support element 46, FIGS. 1–5, rigidly attached to the base of soil disrupter 18, is the support for the chisel type point 48, and adds structural support to static panel 52, and to hinged panel 50 via hinge 62. Support element 46 is slotted vertically rearwardly of soil disrupter 18 allowing wheel 68 to move freely in said slot 88 and to engage the soil 90 below physical support element 46. Chisel point 48 fits tightly into physical support element 46, and is machined with a slot around its base for set screw 54 to enter, thus securing chisel point 48 to support element 46, allowing for replacement. Chisel point 48 is angled 30–45 degrees horizontally to disrupt soil 90 upward, and hardened by tempering with heat for durability.

Wheel 68, FIGS. 1–5, attaches to the inside of static panel 52, with axle 72 utilizing a convex head, allowing silt fence 30 to flow by without snagging, and utilizing hole 78 through static panel 52, for axle 72 to pass through attaching with a lock washer 74 and nut 76. Wheel 68 is a solid piece of material, drilled in the center to facilitate axle 72, and drilled with large holes around its axis, to facilitate the flow of silt fence 30, and to facilitate threading silt fence material 30 prior to operation of silt fence machine 10.

Panels 50 and 52, FIG. 5, are angled outward, above ground level, to funnel silt fence 30 (shown shaded) into the vertical space between panels 50 and 52 below ground level. Rope guide 56 guides rope 32 into panels 50 and 52, between wheel 68 and silt fence material 30. The result is a circumstance in the soil 90 which effectively locks silt fence material 30 in the ground 90 by the rope 30 occupying more space at the bottom of the silt fence material 30 fold than is occupied by the silt fence material 30 alone above the rope 32, thus creating a locking system, see FIGS. 6*a–c*.

Static panel 52, FIGS., 2 and 4, is welded to the side of soil disrupter 18, and to the physical support element 46 by panel support 58. Two dirt shields 80A and 80B, FIGS. 1–4, are also welded on soil disrupter 18 to block soil 90 from entering the void created by the angled panels 50 and 52. Static panel 52 extends rearward to support axle 72. Rope guide support 60 rigidly attaches rope guide 56 to static panel 52 enabling proper guiding of rope 32.

Figure 3:
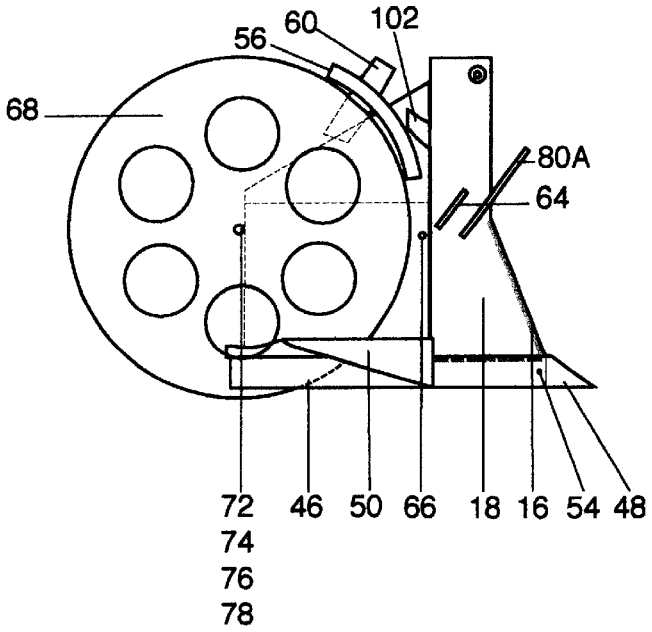
FIG. 3 illustrates the right side view of the apparatus and soil disrupter with hinged panel down.

Hinged panel 50, FIGS. 1–3, attaches to physical support element 46 with hinge 62, and above the soil line with hold down clamp 64, which allows for quick and easy opening thereof for threading of silt fence material 30 between panels 50 and 52, and around wheel 68. Hinged panel 50 extends rearward the same distance as static panel 52, and is notched around the axis area of wheel 68, to facilitate the flow of silt fence material 30 past the axis area. A metal stud 66, FIGS. 1–3, wider at its base than its head, protrudes from panel 52 on the inside and extends through hole 70 in hinged panel 50 to act as a guide for correct positioning of hinged panel 50, and adds strength to hinged panel 50 because clamp 64 can push hinged panel 50 down against stud 66, securing panel 50, and additionally, stud 66 maintains the distance between panels 50 and 52.

Pertaining to the operation of the silt fence machine 10, hinged panel 50 is opened, silt fence material 30, held by support structure 24, is threaded around and under vertical wheel 68 and out the back of silt fence machine 10. Hinged panel 50 is then closed and secured with hold down clamp 64. As the machine 10 moves forward chisel point 48 engages soil 90 and pulls silt fence machine 10 into soil 90. Soil disrupter 18 slices through soil 90 minimally disrupting soil 90 upward and minimizing horizontal compaction.

As silt fence machine 10 levels off, vertical wheel 68 engages soil 90 and begins to rotate, simultaneously in a dynamic operation, silt fence material is funneled to wheel 68 by panels 50 and 52, pulled through panels 50 and 52 by wheel 68, inserted by wheel 68 into soil 90 being held open by panels 50 and 52, and then secured by soil 90 collapsing onto silt fence material 30 as silt fence machine 10 progresses forward. Horizontal compaction would not allow soil 90 to collapse back onto silt fence material 30. Additionally, soil 90 is in optimal condition for vertical compaction, which will tightly secure silt fence material 30 into soil 90.

Optionally, rope 32, approximately ¾ inches diameter, can be inserted into the bottom fold of silt fence material 30 by threading rope 32 between wheel 68 and silt fence material 30, effectively locking silt fence material 30 into soil 90.

Obviously, many modifications and variations of the present invention are possible in light of the above teachings. It is, therefore, to be understood that, within the scope of the pending claims, the invention may be practiced otherwise than as specifically described. To the extent other embodiments are herein created, it is intended they fall within the scope of protection provided by the claims appended hereto.

I claim:

1. A silt fence machine, attached to a power source, to slice through soil and to insert silt fence material at a predetermined depth and position, the silt fence machine comprising a soil disrupter for slicing through said soil, a mechanical means for inserting silt fence material into said soil, the mechanical means including an axle attaching a wheel to a static panel at a predetermined position said wheel constructed with holes around its axis to allow the silt fence material to flow by the wheel without bunching up, and to facilitate threading silt fence material through the silt fence machine, and a support structure for said silt fence material, whereby said silt fence material is inserted into said soil.

2. The silt fence of claim 1, further including a frame that attaches to a power source, and supports said soil disrupter, said mechanical means, and said support structure.

3. The soil disrupter of claim 1, further including a rigid plate of steel of predetermined thickness and shape presenting a forward edge and having a predetermined angle of attack for slicing through said soil a predetermined depth, thus creating a slit in said soil.

4. The soil disrupter of claim 1, further including a horizontal chisel type point extending forwardly at the bottom of said soil disrupter to disrupt said soil in a particular way, and a physical support element for said point.

5. The mechanical means of claim 1, further including a wheel, the wheel adjusted to receive the silt fence material and to move the silt fence material from a horizontal axis position to a vertical axis position.

6. The mechanical means of claim 1, further including a pair of parallel panels extending rearwardly of said soil disrupter, one panel rigidly attached to the soil disrupter forming a static panel, and one panel hinged to the physical support element, said panels simultaneously holding the slit in the soil open below ground and funneling the silt fence material to the vertical wheel above ground.

7. The parallel panels of claim 6, wherein the hinged panel is attached utilizing a hinge along the bottom edge of said panel, and secured near the middle forward edge of said panel utilizing a hold down clamp, allowing the hinged panel to open out, thus enabling silt fence material to be threaded around the wheel, and said panel constructed with a notch cut-out thereof around the axis area, allowing the silt fence material to flow by this axis area unencumbered.

8. The support structure of claim 1, wherein said structure supports said silt fence material in a predetermined position in relation to said wheel for the silt fence material to be inserted into the soil.

9. The structure of claim 1, wherein said structure supports a spool of rope of predetermined thickness, for said rope to be inserted between the wheel and the silt fence material as said silt fence material is inserted into said soil, locking the silt fence material into the soil.

10. The rope of claim 9, further including a guiding means between the spool and the wheel which guides said rope.

11. A method for inserting silt fence material into the soil, where movement of a silt fence machine enables the process and only one moving part is utilized, comprising the steps of slicing through said soil creating a slit, simultaneously holding said slit open, and simultaneously inserting said silt fence material into said soil, the silt fence machine comprising a support structure holding said silt fence horizontally in a predetermined position, enabling said silt fence material to flow properly, and a vertical wheel of predetermined diameter, width, construction, and position interacting with the ground so as to rotate when said machine moves, simultaneously acting as a pivot where said silt fence material in a horizontal position moves around said vertical wheel and between vertical parallel panels thus converting silt fence material to a vertical position and inserting it into the soil as the silt fence machine progresses forward, whereby said silt fence material is secured in said soil at a predetermined depth below and height above the ground.

12. The method of claim 11, said step of slicing, comprising a power source for moving said machine through said soil, a machine utilizing a conventional coulter and a soil disrupter to slice a particular way and predetermined depth through said soil.

13. The method of claim 11, said step of holding said soil open, comprising an apparatus of two parallel panels, extending rearwardly of said soil disrupter in a predetermined position, thus holding said soil open behind said soil disrupter and each panel being angled outward from said soil disrupter at a predetermined height above ground level, helping to funnel said silt fence material into said apparatus.

14. The method of claim 11, wherein said silt fence material is folded disproportionately as it flows into and through said panels, and around said vertical wheel, where a shorter flap flows under the axle of the wheel on one side of the apparatus, while the longer flap flows on the opposite side.

15. The method of claim 11, further including inserting a rope of predetermined thickness between said silt fence material and outside edge of said wheel in the bottom of the fold to lock the silt fence material in the soil.

* * * * *